US006322413B1

(12) United States Patent
Webber

(10) Patent No.: US 6,322,413 B1
(45) Date of Patent: Nov. 27, 2001

(54) FIN

(76) Inventor: Gregory M. Webber, 53 Pacific Street, Angourie, Yamba, New South Wales 2464 (AU)

( * ) Notice: Subject to any disclaimer, the term of this patent is extended or adjusted under 35 U.S.C. 154(b) by 0 days.

(21) Appl. No.: 09/622,947

(22) PCT Filed: Feb. 23, 1999

(86) PCT No.: PCT/AU99/00105

§ 371 Date: Aug. 22, 2000

§ 102(e) Date: Aug. 22, 2000

(87) PCT Pub. No.: WO99/44884

PCT Pub. Date: Sep. 10, 1999

(30) Foreign Application Priority Data

Mar. 2, 1998 (AU) ..... PP 2106

(51) Int. Cl.[7] ..... B63B 1/00
(52) U.S. Cl. ..... 441/79
(58) Field of Search ..... 441/65, 79; D21/778

(56) References Cited

U.S. PATENT DOCUMENTS

| | | | | |
|---|---|---|---|---|
| D. 397,394 | * | 8/1998 | Akins | D21/231 |
| 4,493,665 | | 1/1985 | Liddle | 441/79 |
| 4,940,438 | | 7/1990 | Miller | 441/79 |

* cited by examiner

*Primary Examiner*—Ed Swinehart
(74) *Attorney, Agent, or Firm*—Stephen H. Cagle; Carter J. White; Howrey Simon Arnold & White LLP

(57) ABSTRACT

A side fin (10) for a surfboard has a base edge portion (13) which in use juxtaposes the surfboard, a leading edge (14) and a trailing edge (15) which meet to define fin tip (16). Fin (10) has a substantially planar fin base portion (17) extending from base edge portion (13), and a substantially curved fin tip portion (18) extending from fin base portion (17) to fin tip (16). When the fin profile is viewed in the longitudinal direction of the surfboard i.e. from leading edge (14) to trailing edge (15), the profile of fin base portion (17) is substantially rectilinear and the profile of fin tip portion (18) is curved.

8 Claims, 3 Drawing Sheets

FIN

TECHNICAL FIELD

This invention relates to a fin.

The invention has particular but not exclusive application to fins for surfboards and the like and for illustrative purposes reference will be made throughout the specification to this application. However it is to be understood that the fin of the present invention may be used in other applications including for example, sailboards, yachts, boats, ships and other keeled vessels.

BACKGROUND OF INVENTION

It is known for surfboards to have a central tail fin and a pair of side fins. The side fins aim to increase manoeuvrability. It is also known to design the side fins with a part circular profile when viewed longitudinally.

SUMMARY OF INVENTION

The present invention aims to provide an alternative to known fins for surfboards and the like.

This invention in one aspect resides broadly in a fin for a surfboard or the like, the fin having a base edge portion which in use juxtaposes the surfboard and a leading edge and a trailing edge which meet to define a fin tip, the fin including:

a substantially planar fin base portion extending from the base edge portion, and a substantially curved fin tip portion extending from the fin base portion to the fin tip:

wherein when the fin profile is viewed from the leading edge to the trailing edge, the profile of the fin base portion is substantially rectilinear and the profile of the fin tip portion is curved.

The fin profile may have various configurations. In one preferred embodiment the radius of curvature of the profile of the fin tip portion progressively decreases towards the fin tip. Alternatively the radius of curvature of the fin profile may progressively decrease towards the fin tip. In one preferred embodiment the fin profile is substantially parabolic.

The fin may be integrally formed with the surfboard. However it is preferred that the fin includes mounting means for mounting the fin to a surfboard, the mounting means being disposed at an angle to the fin base portion such that when the fin is mounted to a surfboard at a side thereof the fin base portion extends in an outwardly direction and the fin profile is concave with respect to the longitudinal axis of the surfboard.

In another aspect this invention resides broadly in a surfboard having a pair of side fins each having a base edge portion juxtaposing the surfboard and a leading edge and a trailing edge which meet to define a fin tip, the surface of the side fins including:

a substantially planar fin base portion extending from the base edge portion, and a substantially curved fin tip portion extending from the fin base portion to the fin tip;

wherein when the fin profile is viewed along the longitudinal direction of the surfboard, the profile of the fin base portion is substantially rectilinear and the profile of the fin tip portion is curved;

the fin base portion of the side fins extending in an outwardly direction from the surfboard and the fin profile of each side fin being concave with respect to the longitudinal axis of the surfboard.

DESCRIPTION OF DRAWINGS

In order that this invention may be more easily understood and put into practical effect, reference will now be made to the accompanying drawings which illustrate a preferred embodiment of the invention, wherein.

DESCRIPTION OF PREFERRED EMBODIMENT OF INVENTION

Figure 1:
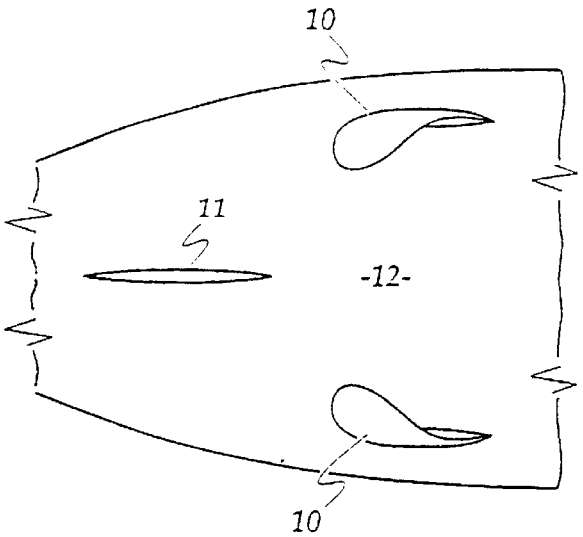
FIGS. 1 to 3 are plan, side and end views respectively of the tail portion of a surfboard showing two side fins in accordance with the present invention and a central fin mounted thereto.
Figure 2:
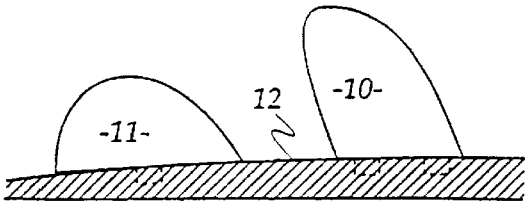
Figure 3:
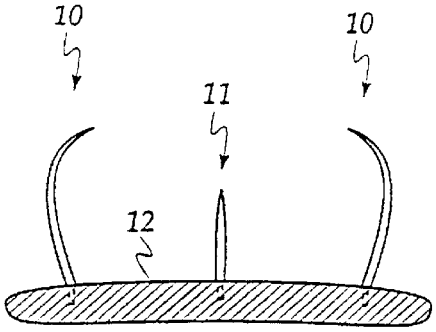

As can be seen in FIGS. 5 to 9, a side fin 10 for a surfboard has a base edge portion 13 which in use juxtaposes the surfboard, a leading edge 14 and a trailing edge 15 which meet to define fin tip 16. Fin 10 has a substantially planar fin base portion 17 extending from base edge portion 13, and a substantially curved fin tip portion 18 extending from fin base portion 17 to fin tip 16.

When the fin profile is viewed in the longitudinal direction of the surfboard ie from leading edge 14 to trailing edge 15, the profile of fin base portion 17 is substantially rectilinear and the profile of fin tip portion 18 is curved.

To most conveniently mount the fins to a surfboard (as seen in FIGS. 1 to 4) a pair of spigots 19 are located on base edge portion 13 for connection in well known manner in receiving mounts (not shown) located in surfboard 12. Surfboard 12 has a central spine fin 11 mounted rearwardly of a pair of laterally disposed side fins 10 in accordance with the present invention.

Figure 4:
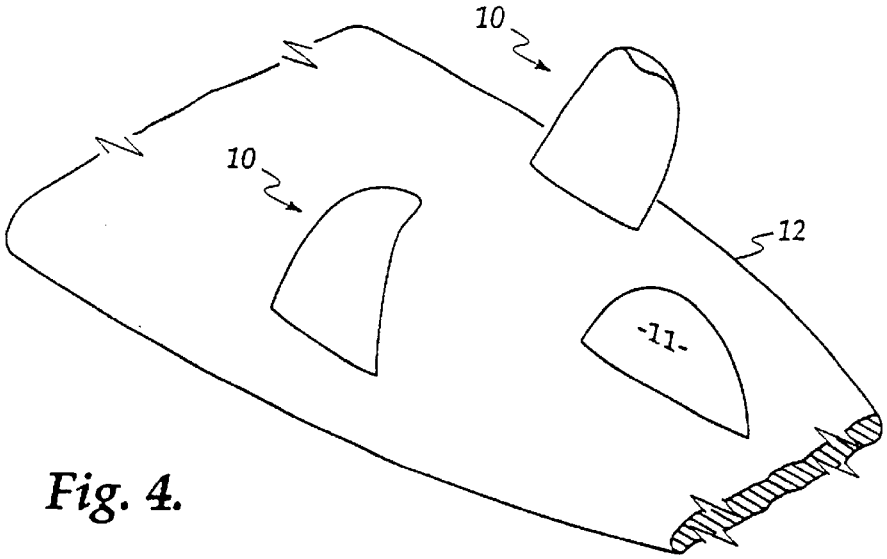
FIG. 4 is a perspective view of the tail portion of the surfboard seen in FIGS. 1 to 3.
Figure 5:
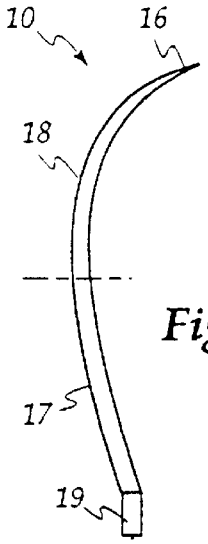
FIGS. 5 to 7 are end, side and plan views respectively of a fin in accordance with the present invention.
Figure 6:
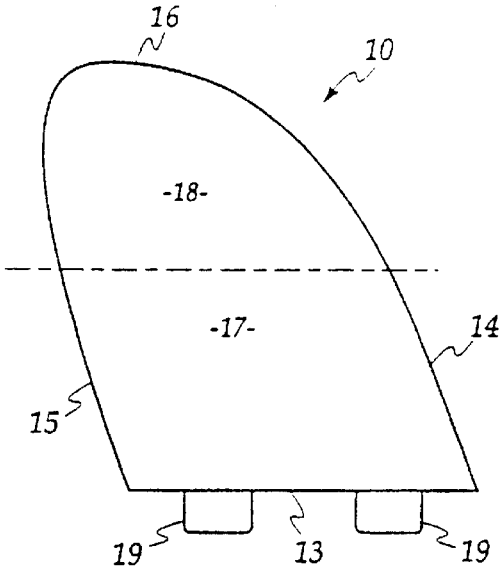
Figure 7:
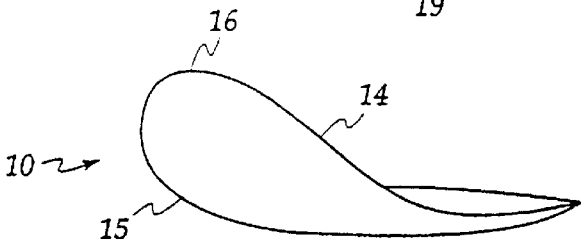
Figure 8:
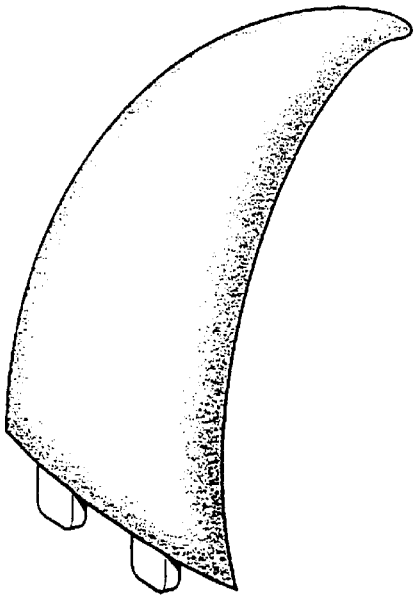
FIGS. 8 and 9 are perspective views of the fin seen in FIGS. 5 to 7, and FIGS. 10A and 10B illustrate some principles of operation of surfboards with curved side fins.
Figure 9:
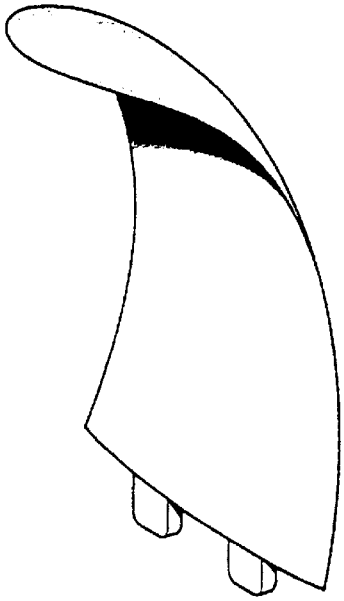

As is best seen in FIG. 4, the mounting spigots 19 are disposed at an angle to fin base portion 17 such that when fins 10 are mounted to surfboard 12 at a side thereof, fin base portion 17 extends in an outwardly direction and the fin profile is concave with respect to the longitudinal axis of surfboard 12.

When viewed in the longitudinal direction of the surfboard ie in the fore to aft direction or from the leading to trailing edge, the profile of the fin in accordance with the present invention can have a number of configurations.

In one embodiment the profile of the fin base portion is rectilinear ie the fin base portion is planar, and the curvature of the fin tip portion is such that the radius of curvature of the profile of the fin tip portion progressively decreases towards the fin tip. Alternatively the profile of the fin base portion can be slightly curved ie the fin base portion is a slightly curved plane, and the radius of curvature of the fin profile progressively decreases towards the fin tip.

In another preferred embodiment the fin profile is substantially parabolic.

During experiments, experienced surfboard riders have found that surfboards having side fins in accordance with the present invention have improved performance characteristics over known surfboards. They have reported improved grip or hold against the wave face, greater ease of manoeuvrability and a substantial improvement in speed generated.

The reasons for the improvements in performance of surfboards fitted with side fins of the present invention over known surfboards are not fully understood. It is thought that it may be due, at least in part, to the emphasised curvature toward the fin tip of the longitudinally viewed fin profile.

Figure 10A:
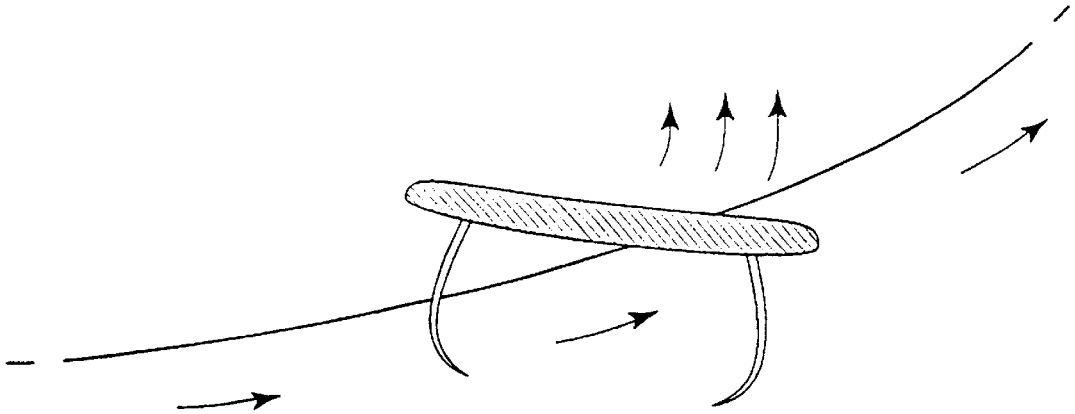
Figure 10B:
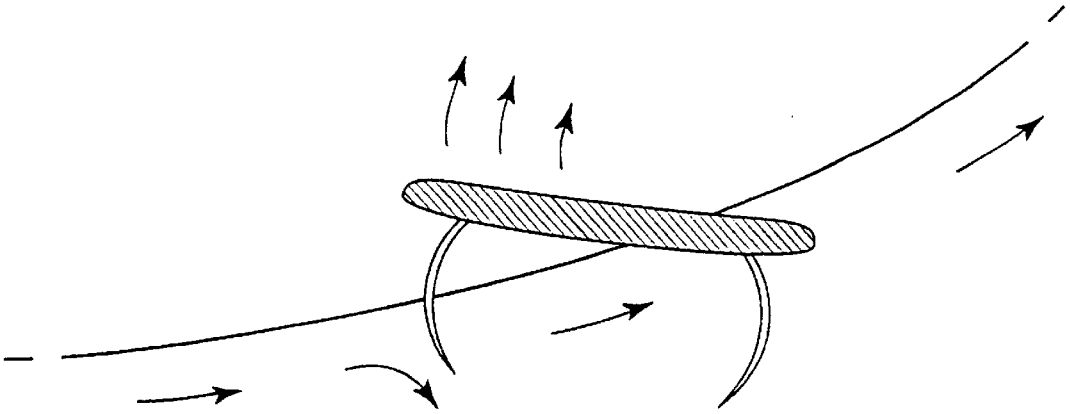

A hypothetical explanation of why this may be so is given with reference to FIGS. 10A and 10B which respectively show different surfboards travelling across a wave face, with one surfboard (FIG. 10A) having the side fins of the present invention and the other (FIG. 10B) having known circularly arced side fins.

Boards with circularly arced side fins balance advantages with disadvantages and are effective only to a nominal degree. It is believed that the improved quality of grip of the side fins of the present invention may derive from the emphasised curvature toward the fin tip of the longitudinally viewed fin profile.

As can be seen if FIG. 10, as a surfboard moves across a wave face the relative movement of the water with respect to the surfboard is upwardly sideways. The forces from the wave might overpower the surfer's downward weighting and result in the surfboard moving away from the wave face. As this occurs the fins which are holding the surfboard from drifting sideways lift away from the wave face, thereby decreasing their ability to resist the sideways momentum of the surfer, and so the surfboard drifts sideways.

As can be seen in FIG. 10A, this effect is diminished in surfboards having the side fins of the present invention because there is adiminished tendency for the flow of water relative to the down-wave side fin to be deflected downwardly (which has the effect of generating lift and imparting a clockwise rotation to the surfboard as viewed thereby increasing instability.) Moreover because of the emphasised curvature toward the fin tip, the up-wave side fin "holds" the wave and thus resists upward movement of the surfboard and the wave energy is thus effective in forcing the surfboard back up in a counterclockwise manner thus offsetting any instabilities generated by the down-wave fin. Moreover it is believed that the greater the speed of the surfboard across the wave face, the greater is the degree of hold on the wave face by the up-wave fin.

On the other hand, as is seen in FIG. 10, the instability effect referred to above is emphasised in surfboards having circularly arced fins because there is a greater tendency for the flow of water relative to the down-wave side fin to be deflected downwardly such that midway through the upward lifting of the surfboard ie the clockwise rotation of the board about its longitudinal axis as viewed, the down-wave fin generates lift and so increases instability. Moreover the regular curvature of the up-wave side fin creates less hold on the wave face than does the emphasised curvature toward the fin tip of the side fin of the present invention.

The side fins of the present invention have a number of advantages over known side fins. Circularly arced side fins and flat sided side fins increase grip to some extent but this is countered by a decrease in manoeuvrability as well as an increase in drag through turning. The increased grip provided by the side fins of the present invention allow a more upright side profile to be used without the loss of control usually arising as the side profile becomes more upright.

The side fins of the present invention provide an increase in grip of the surfboard on the wave face and a decrease in drag through turning, thus providing improved manoeuvrability and an increase in speed generated.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

Thus it will be apparent that the invention can be utilised advantageously in other water craft including sailboards as well as ships, yachts and sail boats when travelling across the direction of wave motion.

What is claimed is:

1. A fin for a surfboard, said fin having a base edge portion which in use juxtaposes the surfboard and a leading edge and a trailing edge which meet to define a fin tip, said fin including:

a substantially planar fin base portion extending from said base edge portion, and a substantially curved fin tip portion extending from said base portion to said fin tip;

wherein when the fin profile is viewed from the leading edge to the trailing edge, the profile of said fin base portion is substantially rectilinear and the profile of said fin tip portion is curved.

2. A fin as claimed in claim 1, wherein the radius of curvature of said profile of said fin tip portion progressively decreases towards the fin tip.

3. A fin as claimed in claim 2, wherein said profile of said fin tip portion is substantially parabolic.

4. A fin as claimed in claim 1, wherein said fin profile is substantially parabolic.

5. A fin as claimed in claim 1, and including mounting means for mounting the fin to a surfboard, said mounting means being disposed at an angle to said fin base portion such that when the fin is mounted to a surfboard at a side thereof said fin base portion extends in an outwardly direction and the fin profile is concave with respect to the longitudinal axis of the surfboard.

6. A fin for a surfboard comprising, a base edge portion which in use juxtaposes the surfboard and a leading edge and a trailing edge which meet to define a fin tip;

one or more spigot connected to said base edge, said spigot for connecting said fin to said surfboard;

a substantially planar fin base portion extending from said base edge portion, and a substantially curved fin tip portion extending from said base portion to said fin tip;

wherein when the fin profile is viewed from the leading edge to the trailing edge, the profile of said fin base portion is substantially rectilinear and the profile of said fin tip portion is curved.

7. A fin for a water craft comprising, a base edge portion which in use juxtaposes the water craft and a leading edge and a trailing edge which meet to define a fin tip;

a substantially planar fin base portion extending from said base edge portion, and a substantially curved fin tip portion extending from said base portion to said fin tip;

wherein when the fin profile is viewed from the leading edge to the trailing edge, the profile of said fin base portion is substantially rectilinear and the profile of said fin tip portion is curved.

8. The fin of claim 7, wherein the water craft is a surfboard, sailboard, ship, yacht or sail boat.

* * * * *